US006519567B1

(12) United States Patent
Fujii

(10) Patent No.: US 6,519,567 B1
(45) Date of Patent: Feb. 11, 2003

(54) TIME-SCALE MODIFICATION METHOD AND APPARATUS FOR DIGITAL AUDIO SIGNALS

(75) Inventor: Shigeki Fujii, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/564,187

(22) Filed: May 4, 2000

(30) Foreign Application Priority Data

May 6, 1999 (JP) ..... 11-126356

(51) Int. Cl.[7] ..... G10L 21/04

(52) U.S. Cl. ..... 704/503; 704/504; 704/500; 84/609

(58) Field of Search ..... 704/503, 504, 704/500; 84/609, 612, 652

(56) References Cited

U.S. PATENT DOCUMENTS 5,641,927 A * 6/1997 Pawate et al. ..... 84/609
6,073,100 A * 6/2000 Goodridge, Jr. ..... 704/258
6,232,540 B1 * 5/2001 Kondo ..... 84/612

OTHER PUBLICATIONS

Morita, Naotaka & Fumitada Itakura, School of Engineering, Nagoya University, "Time–Scale Modification Algorithm for Speech by Use of Pointer Interval Control Overlap and Add (Picola) and its Evaluation", pp. 149–150.

* cited by examiner

*Primary Examiner*—Susan McFadden
(74) *Attorney, Agent, or Firm*—Pillsbury Winthrop LLP

(57) ABSTRACT

A time-scale modification method or apparatus performs time-scale modification (i.e., compression or expansion with respect to time) on original audio signals having waveforms. Adjacent wave segments are divided and cut from the waves of the original audio signals by various lengths. A certain number of samples are thinned out from each of the adjacent waveform segments to provide a reduced amount of data. Calculations are performed on the reduced amount of data to sequentially produce similarities between the adjacent wave segments in response to the various lengths. The similarities are evaluated to determine a length that provides a best similarity within the various lengths as a basic period. The waves of the original audio signals are divided and cut into two waves by the basic period. Time-scale modification is effected on the two waves to produce a mixed wave. Using the mixed wave, it is possible to provide output signals, which correspond to results of the time-scale modification on the original audio signals in accordance with a designated time-scale modification factor without causing pitch variations.

22 Claims, 6 Drawing Sheets

Time
T0
Lmax
Lmax
Lmin
Lmin

Time
Lp
Lp
L

Wave A
Wave B
Time
T0
T0 + L

Wave A
Time

Wave B
Time

L−2*Lp
Wave A + Wave B
New T0

Time
T0
Lmax
Lmax
Lmin
Lmin

Time
Lp
Lp
L

Wave A
Wave B
Time
T0
T0+L

Time

+
Time
L–2* Lp

Time
Wave A
Wave A + Wave B
Wave B
New T0

TIME-SCALE MODIFICATION METHOD AND APPARATUS FOR DIGITAL AUDIO SIGNALS

BACKGROUND OF THE INVENTION

1. Field of the Invention

This invention relates to time-scale modification methods and apparatuses that perform time-scale modification (i.e., compression or expansion with respect to time) on digital audio signals without changing original pitches and sound qualities in accordance with desired time-scale modification factors.

This application is based on Patent Application No. Hei 11-126356 filed in Japan, the content of which is incorporated herein by reference.

2. Description of the Related Art

Normally, time-scale modification techniques are effected to perform compression and expansion on digital audio signals with respect to time, where the original pitches of the digital audio signals are not changed. Those techniques are used in a variety of fields such as so-called "scale adjustment" in which an overall recording time for recording digital audio signals is adjusted to a prescribed time and tempo modification" used by Karaoke apparatuses, for example. A cut-and-splice method is known as one of the time-scale modification techniques and is disclosed in the paper entitled "Time-Scale Modification Algorithm for Speech by Use of Pointer Interval Control Overlap and Add (PICOLA) and Its Evaluation", written by Morita and Itakura on Pp. 149–150 of monographs 1-4-14 issued for the autumn meeting of Japan Acoustics Engineering Society in October 1986.

The Morita and Itakura paper discloses two wave segments, which are adjacent to each other in original audio signal waves and which are closely related to each other with highest waveform correlation, are extracted and are subjected to duplicate addition to produce a mixed wave. Thus, an overall time of the audio signals is shortened by substituting the mixed wave between the two wave segments.

FIGS. 5A–5F and FIGS. 6A–6F show waveforms, which are used to explain concrete operations of time-scale modification processing being effected on original audio signals. Specifically, FIGS. 5A–5F show concrete operations of time-scale compression, while FIGS. 6A–6F show concrete operations of time-scale expansion.

FIGS. 5A, 6A show original waveforms corresponding to original audio data on a prescribed time scale. Herein, similarity detection processes are performed to extract a basic period Lp that emerge with respect to adjacent wave segments on the time scale. Concretely speaking, a minimal value Lmin is set as an initial value for a wave segment length, so that similarity is detected between adjacent wave segments each corresponding to Lmin. Such similarity detection is repeatedly performed by gradually increasing the length from Lmin and is stopped when the length is increased to a maximal value Lmax. Herein, all lengths are examined with respect to similarities, so that a certain length that provides a best similarity is selected from among the lengths and is determined as the basic period Lp, which is shown in FIGS. 5B, 6B. For the time-scale modification, two wave segments (i.e., waves A, B) which are adjacent to each other and each of which corresponds to the basic period Lp are extracted and are respectively subjected to multiplication with a certain window function, which is shown in FIGS. 5C, 6C. In the case of the time-scale compression shown in FIG. 5C, the wave A is subjected to multiplication having a level-decreasing slope to produce a wave of FIG. 5D, while the wave B is subjected to multiplication having a level-increasing slope to produce a wave of FIG. 5E. Those waves of FIGS. 5D, 5E are mixed together to produce a mixed wave, which substitutes the two waves A, B in FIG. 5F. In the case of the time-scale expansion shown in FIG. 6C, the wave A is subjected to multiplication having a level-increasing slope to produce a wave of FIG. 6D, while the wave B is subjected to multiplication having a level-decreasing slope to produce a wave of FIG. 6E. Those waves of FIGS. 6D, 6E are mixed together to produce a mixed wave, which is inserted between the waves A, B in FIG. 6F.

The aforementioned time-scale modification technique suffers from a problem in which a great amount of processing is required for similarity evaluation (i.e., similarity detection and examination) to extract the basic period from the original audio data. In the conventional similarity evaluation, similarity calculations are repeated every time the length is increased by a prescribed value within a range between Lmin and Lmax with respect to each of wave segments, wherein the calculations are performed on all samples contained in each wave segment being examined. So, as a sampling frequency becomes higher, the amount of processing required for the similarity evaluation should be greatly increased.

It is expected that the sampling frequency ranges from 50 Hz to 200 Hz. In other words, a maximal length for the wave segment is given by the sampling frequency of 50 Hz, and a minimal length is given by the sampling frequency of 200 Hz. The inventor of this invention evaluates similarity calculations which are needed with respect to each of prescribed sampling frequencies. Table 1 shows total numbers of arithmetic operations (e.g., multiplication and addition) being required for the similarity calculations with respect to three sampling frequencies, i.e., 16 kHz, 32 kHz and 48 kHz.

TABLE 1

| Sampling Frequency | Lmin (samples) | Lmax (samples) | Operations (addition, subtraction) | Operations (multiplication) |
|---|---|---|---|---|
| 16 kHz | 80 | 320 | 96,000 | 48,000 |
| 32 kHz | 160 | 640 | 288,000 | 144,000 |
| 48 kHz | 320 | 1,280 | 1,536,000 | 768,000 |

Table 1 shows that increasing the sampling frequency bring a great increase of a number of arithmetic operations required for the similarity calculations. That is, an amount of processing for the similarity evaluation is remarkably increased in response to an increase of the sampling frequency.

SUMMARY OF THE INVENTION

It is an object of the invention to provide a time-scale modification method or apparatus that performs time-scale modification on audio signals with a reduced amount of processing particularly related to similarity evaluation for evaluating similarities between adjacent wave segments.

A time-scale modification method or apparatus of this invention performs time-scale modification (i.e., compression or expansion with respect to time) on original audio signals having waves. Adjacent wave segments are divided and cut from the waves of the original audio signals by various lengths. Herein, a certain number of samples are thinned out from each of the adjacent wave segments to provide a reduced amount of data regarding each of the adjacent wave segments. Calculations are performed on the reduced amount of data to sequentially produce similarities between the adjacent wave segments in response to the various lengths being sequentially changed over. The similarities are evaluated to determine a length that provides a best similarity within the various lengths as a basic period. Thus, the waves of the original audio signals are divided and cut into two waves by the basic period. Time-scale modification is effected on the two waves to produce a mixed wave. Using the mixed wave, it is possible to provide output signals, which correspond to results of the time-scale modification being effected on the original audio signals in accordance with a designated time-scale modification factor without causing pitch variations.

In the case of compression, the two waves are subjected to windowed multiplication and addition to produce a mixed wave, which substitutes for the two waves, so that the original audio signals are compressed by the basic period. In the case of expansion, the two waves are subjected to windowed multiplication and addition to produce a mixed wave, which is inserted between the two waves, so that the original audio signals are expanded by the basic period.

Because data of the wave segments are adequately reduced for calculations of the similarities while the time-scale modification is effected on entire data of the original audio signals, it is possible to reduce an overall amount of processing without causing deterioration in sound quality of reproduced sounds being reproduced by way of the time-scale modification. Incidentally, the data are reduced by thinning out a single sample per every two samples of the original audio signals, or the data are reduced by thinning out two samples per every three samples of the original audio signals, for example.

BRIEF DESCRIPTION OF THE DRAWINGS

These and other objects, aspects and embodiment of the present invention will be described in more detail with reference to the following drawing figures, of which.

DESCRIPTION OF THE PREFERRED EMBODIMENT

This invention will be described in further detail by way of examples with reference to the accompanying drawings.

Figure 1:
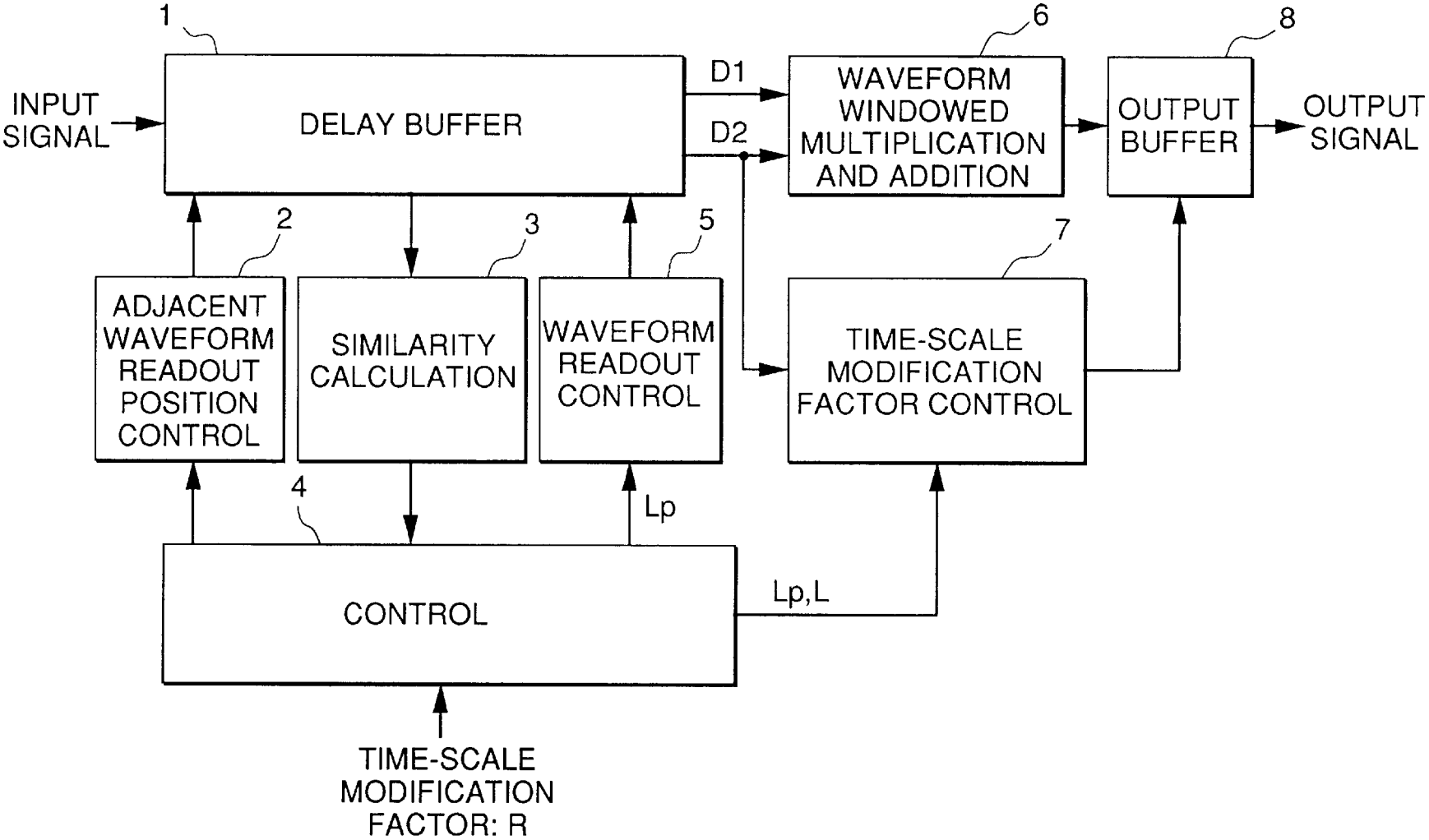
FIG. 1 is a block diagram showing a configuration of a time-scale modification apparatus that performs time-scale modification on audio signals in accordance with preferred embodiment of the invention.

FIG. 1 is a block diagram showing a configuration of a time-scale modification apparatus that performs time-scale modification (i.e., compression or expansion with respect to time) on digital audio signals in accordance with embodiment of the invention.

There are provided original digital audio signals (i.e., subjects on which time-scale modification is being effected), which are sequentially input to a delay buffer 1. The delay buffer 1 is configured by a ring buffer having a storage capacity for storing a certain amount of data which are needed for execution of time-scale modification and pitch extraction on waves of the digital audio signals. The original digital audio signals stored in the delay buffer 1 are cut into wave segments having various (time) lengths under control of an adjacent waveform readout position control section 2. So, data of the wave segments are sequentially read from the delay buffer 1 as adjacent wave data. Herein, the adjacent waveform readout position control section 2 thins out a certain number of samples on a time scale when reading out the adjacent wave data. A similarity calculation section 3 calculates similarities between the adjacent wave data being sequentially read out under the control of the adjacent waveform readout position control section 2. A control section 4 detects a specific length that provides a best similarity between adjacent waves within the similarities calculated by the similarity calculation section 3. So, the control section 4 sets the detected length as a basic period Lp, which is forwarded to a waveform readout control section 5. Thus, two data which depart from each other by the basic period Lp are read from the delay buffer 1 under the control of the waveform readout control section 5. That is, two data D1, D2 are read from the delay buffer 1 and are supplied to a time-scale modification processing unit, which is configured by a waveform windowed multiplication and addition section 6, a time-scale modification factor control section 7 and an output buffer 8. In the waveform windowed multiplication and addition section 6, the two data D1, D2 are respectively subjected to multiplication using a prescribed time window function and addition. The data D2 is also supplied to the time-scale modification factor control section 7. The time-scale modification factor control section 7 cuts the original digital audio signals into waves based on information representing a subject length L for time-scale modification, which is given from the control section 4. Herein, the control section 4 calculates the subject length L based on a designated time-scale modification factor R and the basic period Lp. In the waveform windowed multiplication and addition section 6, the two data D1, D2 are multiplied by different coefficients and are added together to produce a mixed wave. The output buffer 8 mixes the original waves, which are cut by the time-scale modification factor control section 7, with the mixed wave to produce output signals, which correspond to results of time-scale modification being effected on the original digital audio signals in accordance with the designated time-scale modification factor R.

Next, operations of the time-scale modification apparatus of FIG. 1 will be described with reference to FIGS. 2 and 3.

Figure 2:
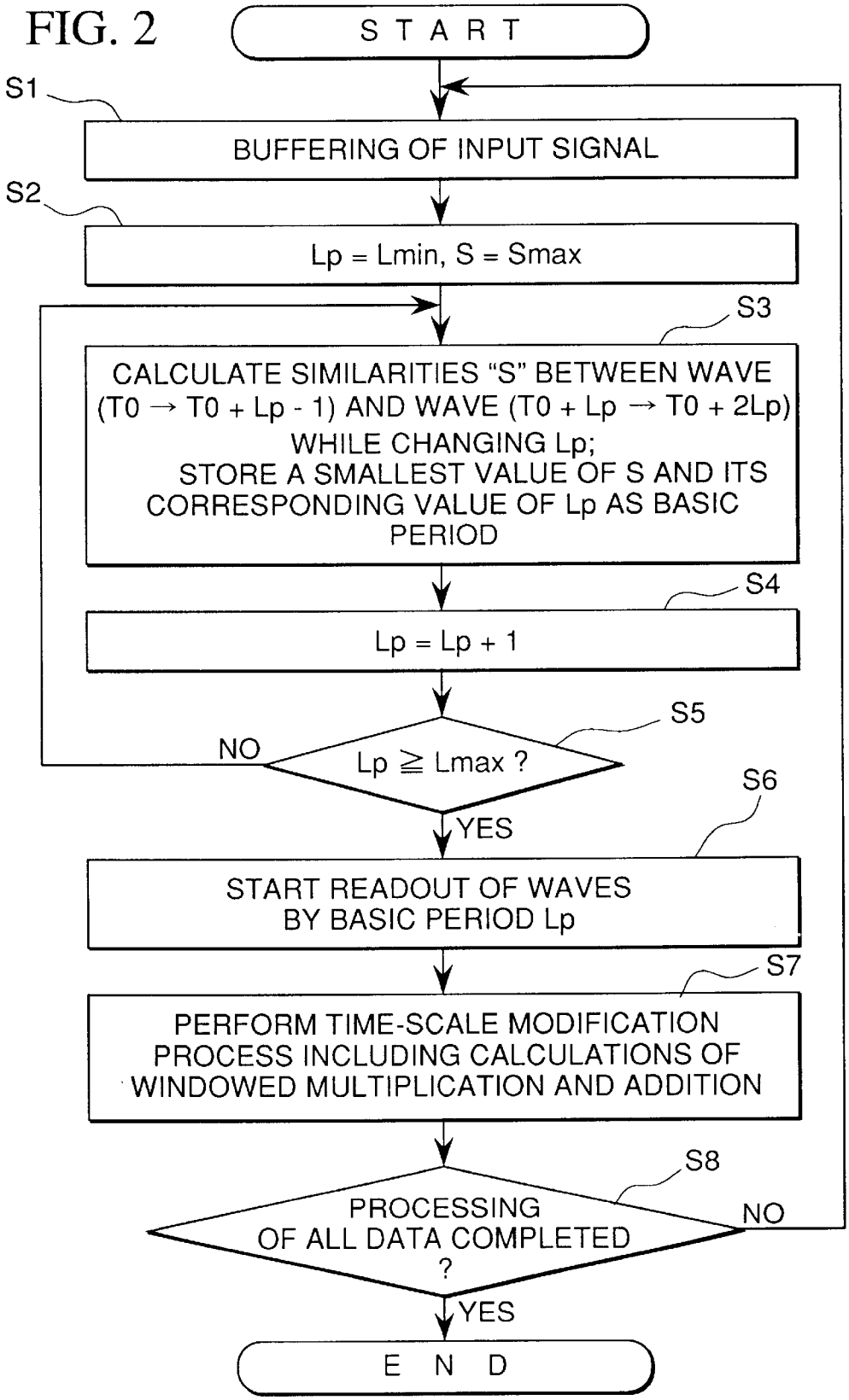
FIG. 2 is a flowchart showing procedures of time-scale modification processing being performed by the time-scale modification apparatus of FIG. 1.

FIG. 2 is a flowchart showing procedures of time-scale modification processing being actualized by the time-scale modification apparatus of FIG. 1.

In step S1, the delay buffer 1 stores a certain amount of input signals corresponding to original digital audio signals, which are needed for execution of the time-scale modification processing. The delay buffer 1 has a storage capacity for storing at least 2×Lmax samples, for example. In step S2, a minimal value Lmin is given as an initial value of the length Lp which is used for similarity detection and examination (or similarity evaluation), and a maximal value Smax is given as similarity S. In step S3, the similarity calculation section 3 calculates similarities S between adjacent waves with respect to a certain value of the length Lp. In step S4, the length Lp is incremented by "1". Thus, similarity calculations are repeatedly performed while changing Lp from the minimal value Lmin and are stopped when Lp reaches a maximal value Lmax in steps S3, S4 and S5. Thus, the control section 4 detects a specific length that provides a best similarity within the lengths being examined. So, the control section 4 sets such a specific length as a basic period (Lp). As shown in FIGS. 5A–5F and FIGS. 6A–6F, the similarity S is calculated and examined between a wave A, which lies in a period of time between T0 and T0+Lp−1, and a wave B which lies in a period of time between T0+Lp and T0+2Lp. If starting positions of the waves A, B are denoted by tx and tx+Lp respectively, the similarity S is given by a sum of square errors, which is calculated in accordance with an equation (1), as follows:

$$S = \frac{1}{Lp}\sum_{i=0}^{Lp-1}\{D(tx) - D(tx+Lp)\}^2 \tag{1}$$

The above equation shows that the similarity becomes higher (or better) as a calculated value of S becomes smaller. The present embodiment uses the sum of square errors as one example of the similarity calculations. Hence, it is possible to use other calculations such as an absolute sum of errors and an auto-correlation function, for example. An important characteristic of the present apparatus is to reduce a number of data used for similarity evaluation. That is, the present apparatus does not use all the data of the original waves for the similarity evaluation, but it thins out some parts from the data of the original waves to reduce a total number of data being used for the similarity evaluation.

Figure 3:
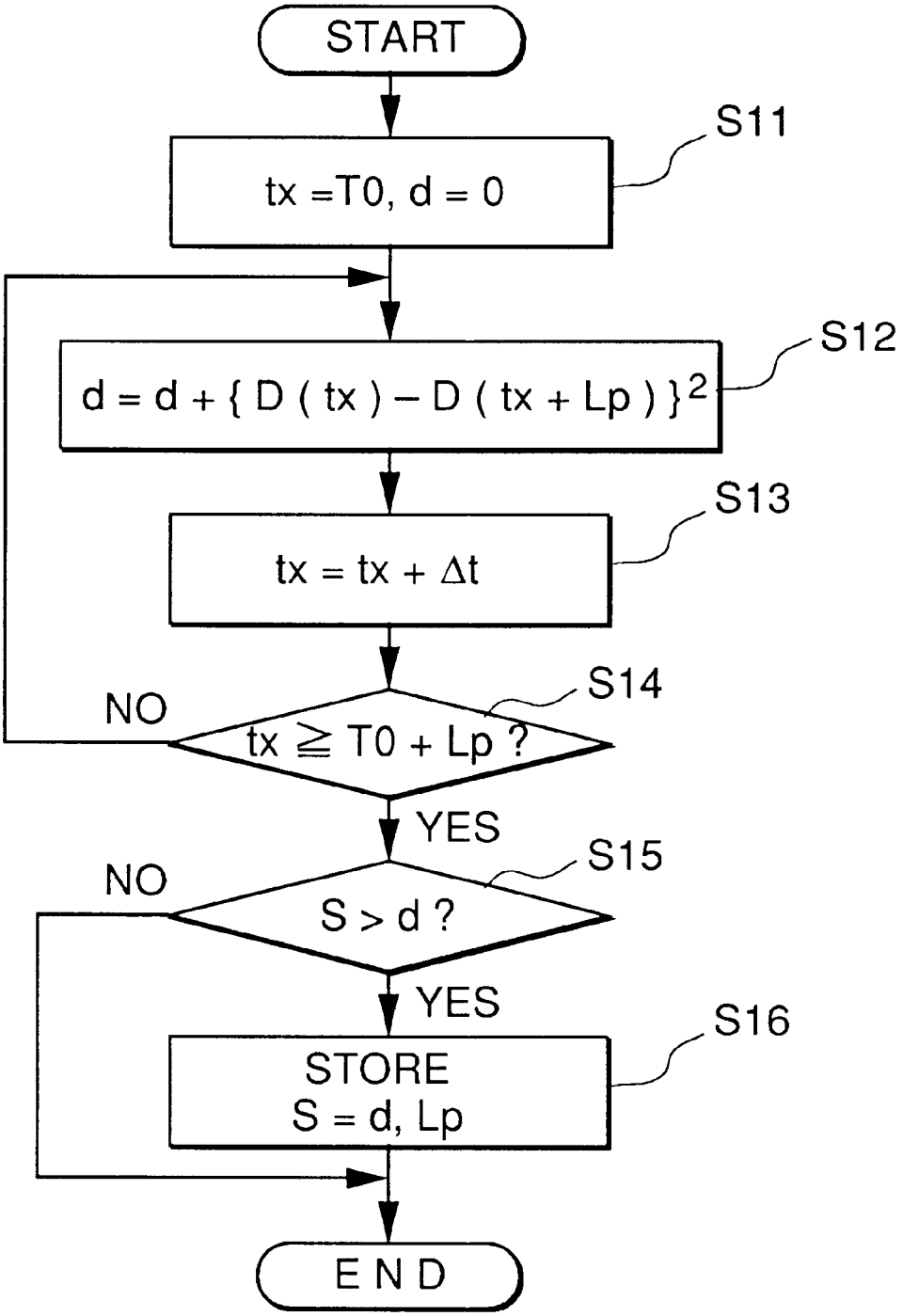
FIG. 3 is a flowchart showing procedures of similarity evaluation.

FIG. 3 is a flowchart showing details of a similarity evaluation process, which substantially corresponds to the aforementioned step S3 in FIG. 2.

In step S11, a time parameter tx is initialized to T0, and a square error accumulated value d is reset to 0. In step S12, the similarity calculation section 3 performs calculations of "d" in accordance with an equation (2) as follows:

$$d=d+[D(tx)-D(tx+Lp)]^2 \tag{2}$$

In step S13, it updates the time parameter tx to tx+Δt. Herein, a step time Δt is given by an addition of "(thin-out number)+1", where "thin-out number" designates a number of samples being thinned out on the time scale. According to the equation (2), a square error is accumulated to d until tx is increased to reach or exceed T0+Lp in steps S12 to S14. When the time parameter tx reaches or exceeds T0+Lp, the similarity calculation section 3 stops calculations to define a lastly calculated value of d, which is compared with the aforementioned similarity S in step S15. If S>d, S is updated by d, in other words, d is substituted for S. In step S16, "updated" S and its corresponding length Lp are stored in some storage (not shown).

The aforementioned steps are repeated until the length Lp reaches or exceeds the maximal value Lmax by steps S3 to S5. As a result, it is possible to determine a minimal value of the similarity S and its corresponding length Lp (i.e., basic period). In step S6 shown in FIG. 2, the waveform readout control section 5 starts readout of waves on the basis of the basic period Lp. In step S7, the present apparatus performs time-scale modification, specifically, time-scale compression of FIGS. 5A–5F or time-scale expansion of FIGS. 6A–6F. Concretely speaking, two adjacent waves A, B each corresponding to the basic period Lp are cut from the original waves and are subjected to windowed multiplication to produce the foregoing waves of FIGS. 5D, 6D and FIGS. 5E, 6E. Those waves are added together to produce a mixed wave, i.e., "wave A+wave B" shown in FIGS. 5F, 6F. Hence, the time-scale compression is actualized by substituting the mixed wave for the adjacent waves A, B, while the time-scale expansion is actualized by inserting the mixed wave between the adjacent waves A, B. Thus, it is possible to obtain time-scale modified outputs. Incidentally, the time-scale modification factor R can be expressed using the subject length L (i.e., length of a wave subjected to time-scale modification), as follows:

(1) Time-scale compression (R<1.0, Lp≦L/2)

$$R = \frac{L - Lp}{L}$$

(2) Time-scale expansion (R>1.0)

$$R = \frac{L + Lp}{L}$$

Therefore, the subject length L can be expressed as follows:

(1) Time-scale compression $$L = \frac{Lp}{1 - R}$$

(2) Time-scale expansion $$L = \frac{Lp}{R-1}$$

The control section 4 calculates the subject length L based on the time-scale modification factor R and the basic period Lp, so that the subject length L is forwarded to the time-scale modification factor control section 7. Based on the basic period Lp and the subject length L, the time-scale modification factor control section 7 extracts a part of the original waves, which are needed for combination with the mixed wave produced by the waveform windowed multiplication and addition section 6 and which are forwarded to the output section 8. Thus, the output section combines the mixed wave with the extracted part of the original waves to produce output signals, corresponding to results of the time-scale modification processing which is effected on the input signals in response to the designated time-scale modification factor. The aforementioned processes are repeated with respect to all data of the original digital audio signals in step S8.

Figure 4A:
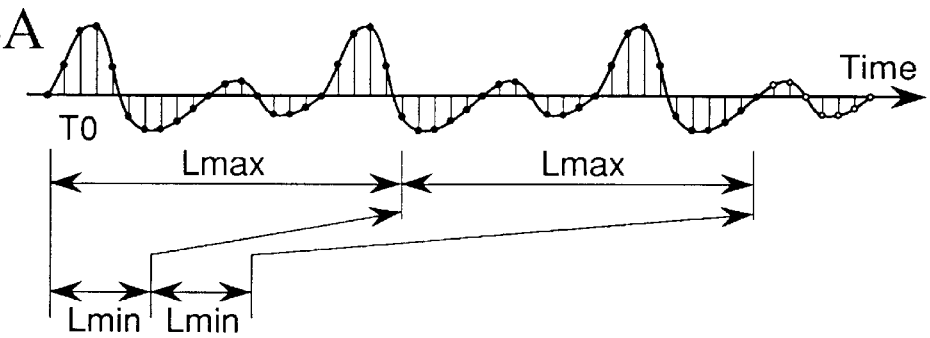
FIG. 4A shows original waves of original audio signals being subjected to time-scale modification.
Figure 4B:
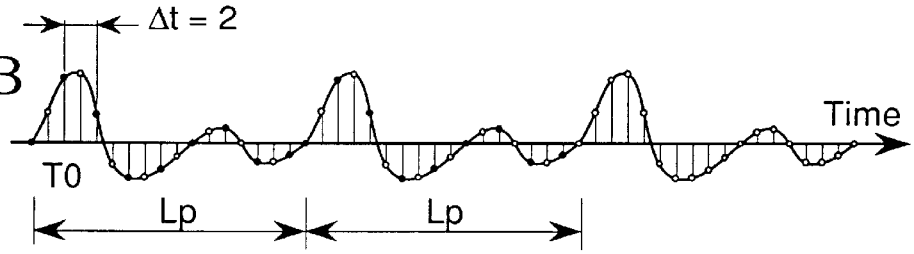
FIG. 4B shows a reduced amount of data which are produced by thinning out a single sample per every two samples of the original waves.
Figure 4C:
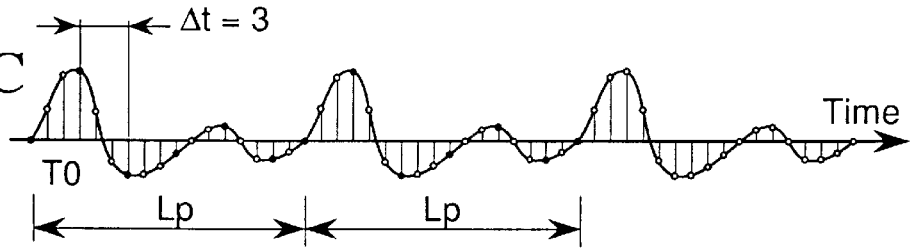
FIG. 4C shows a reduced amount of data which are produced by thinning out two samples per every three samples of the original waves.
Figures 5A, 5B, 5C, 5D, 5E, 5F:
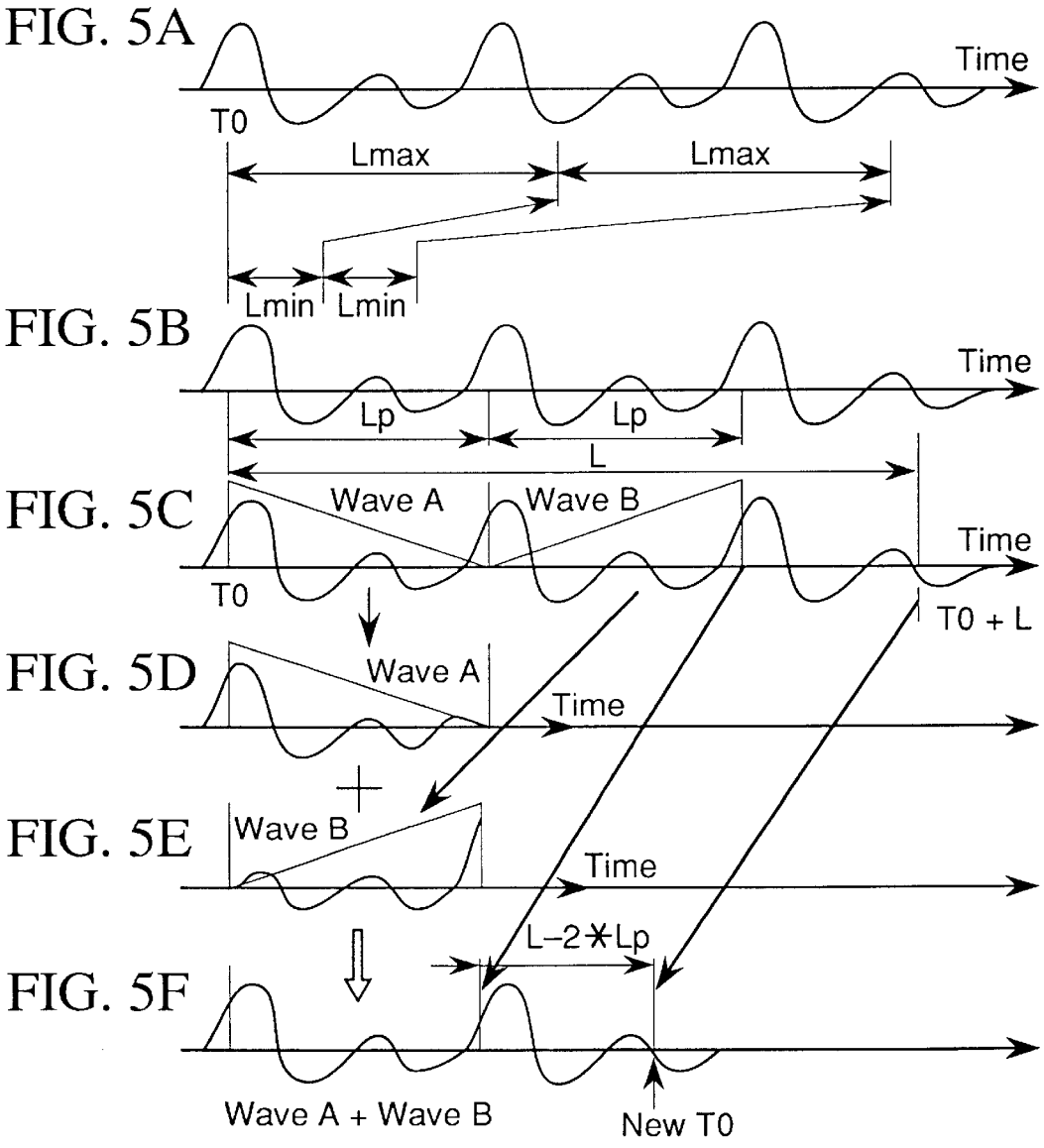
FIG. 5A shows original waves of original audio signals being subjected to time-scale compression.
FIG. 5B shows extraction of a basic period Lp by evaluating similarities between adjacent wave segments within the original waves.
FIG. 5C shows two waves A, B which are divided and cut from the original waves by the basic period and are respectively subjected to windowed multiplication using different coefficients.
FIG. 5D shows a wave that is produced by effecting multiplication on the wave A.
FIG. 5E shows a wave that is produced by effecting multiplication on the wave B.
FIG. 5F shows a mixed wave which is produced by mixing the waves of FIGS. 5D, 5E together and which substitutes for the two waves on the original waves.
Figures 6A, 6B, 6C, 6D, 6E, 6F:
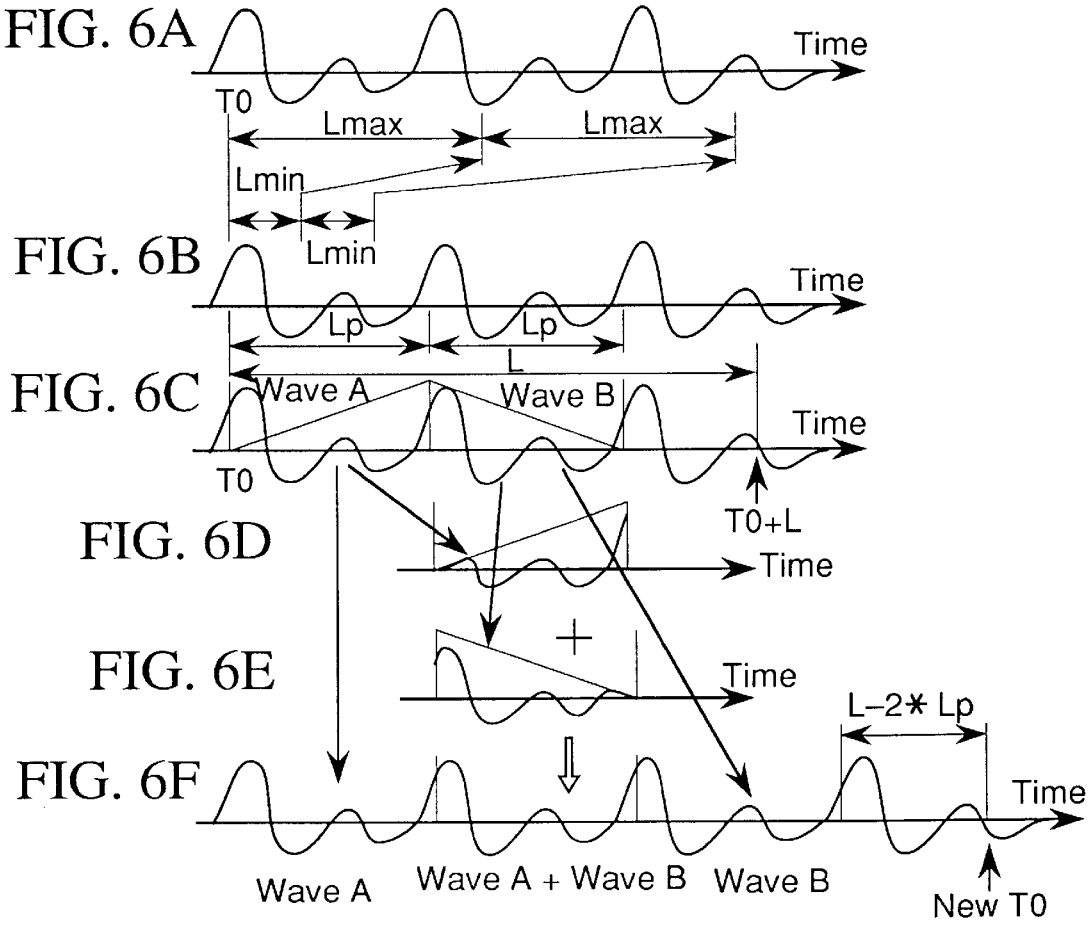
FIG. 6A shows original waves of original audio signals being subjected to time-scale expansion.
FIG. 6B shows extraction of a basic period Lp by evaluating similarities between adjacent wave segments within the original waves.
FIG. 6C shows two waves A, B which are divided and cut from the original waves by the basic period and are respectively subjected to windowed multiplication using different coefficients.
FIG. 6D shows a wave that is produced by effecting multiplication on the wave A.
FIG. 6E shows a wave that is produced by effecting multiplication on the wave B.
FIG. 6F shows a mixed wave which is produced by mixing the waves of FIGS. 6D, 6E together and which is inserted between the two waves on the original waves.

According to the present embodiment, calculation is performed to produce the similarity S by the period Lp while thinning out a certain number of samples on the time scale. Thus, it is possible to perform the similarity calculations at a high speed. FIG. 4A shows original waves on which black points are plotted to represent samples, wherein no thin-out operation is performed. FIG. 4B shows waves on which a single white point is disposed between two black points to represent a thin-out sample, wherein a thin-out number is "1"(i.e., $\Delta t=2$). FIG. 4C shows waves on which two white points are disposed between two black points to represent thin-out samples, wherein a thin-out number is "2"(i.e., $\Delta t=3$). In the case of correlation operations of waves, substantially no big differences emerge in calculation results although the thin-out operations are performed on the original waves. For this reason, the thin-out operations do not substantially deteriorate an accuracy of calculations in outputs.

The inventor of this invention performs comparison between amounts of processing, which are required to produce calculation results with or without thin-out operations. Table 2 shows comparison results in which amounts of processing are examined with respect to different thin-out ratios. Table 2 clearly shows that a number of calculation processes can be considerably reduced by the thin-out operations.

TABLE 2

| Thin-out ratio | Lmin (samples) | Lmax (samples) | Operations (addition, subtraction) | Operations (multiplication) |
|---|---|---|---|---|
| Zero | 320 | 1,280 | 1,536,000 | 768,000 |
| ½ | 160 | 640 | 288,000 | 144,000 |
| ¼ | 80 | 320 | 96,000 | 48,000 |
| ⅛ | 40 | 160 | 24,000 | 12,000 |

The present embodiment fixedly sets a certain thin-out number (e.g., 1, 2, . . . ). Instead, it is possible to propose various method for adaptively changing the thin-out number, as follows:

(a) The thin-out number is increased in response to the length Lp being set by every calculation.

(b) The thin-out number is temporarily fixed at a preceding number corresponding to the basic period (Lp) which is previously determined.

Lastly, this invention can be provided in forms of storage devices or media such as floppy disks, hard disks, memory cards and the like, which store programs and data actualizing functions of the present embodiment. Or, programs and data of the present embodiment can be downloaded to the computer system to actualize the time-scale modification techniques from the computer network such as Internet by way of MIDI terminals, for. example.

As described heretofore, this invention has a variety of technical features and effects, which are summarized as follows:

(1) When effecting similarity evaluation on adjacent waves of original audio signals on time scale, a total number of samples used for similarity calculation is reduced by thinning out a certain number of samples within data of the adjacent waves to be compared with each other. Thus, it is possible to reduce an amount of processing that is needed for the similarity evaluation.

(2) Since the similarity evaluation is performed together with extraction of the basic period being extracted from the original waves, it is possible to maintain outlines of the original waves even if the total number of samples used for the similarity evaluation is reduced by thinning out the certain number of samples within the data of the original waves. Hence, thinning out the samples do not badly influence results of the similarity evaluation. Therefore, it is possible to improve an overall processing speed in the time-scale modification processing without deteriorating output signals in sound quality.

(3) An interval of time for thinning out a sample (or samples) from samples of the original waves on the time scale can be varied in response to the lengths used for comparison of the adjacent waves. Or, it can be determined based on the basic period, which is previously determined in a previous cycle of similarity evaluation.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A time-scale modification method comprising the steps of:

performing similarity evaluation to evaluate similarities between adjacent waveforms of original audio signals on a time scale to extract a basic period that provides a best similarity;

performing at least one of deleting and inserting, at least one waveform of the basic period in the adjacent waveforms of the original audio signals; and producing output signals corresponding to results of a time-scale modification which is effected on the original audio signals according to a designated time-scale modification factor without causing pitch variations, wherein the similarity evaluation is performed on a reduced amount of data which are provided by thinning out unwanted data from all data of the adjacent waveforms being compared with each other on the time scale.

2. The time-scale modification method according to claim 1, wherein an interval of time for thinning out the unwanted data is varied in response to a length by which each of the adjacent waveforms is being divided.

3. The time-scale modification according to claim 1, wherein an interval of time for thinning out the unwanted data is determined based on the basic period, which is determined in a previous cycle of the similarity evaluation.

4. The time-scale modification method according to claim 1, wherein the waveform of the basic period is deleted from the adjacent waveforms when the time-scale modification corresponds to compression with respect to time, and wherein the waveform of the basic period is inserted between the adjacent waveforms when the time-scale modification corresponds to expansion with respect to time.

5. A time-scale modification apparatus, comprising:

a waveform memory for storing a certain amount of waveforms of original audio signals being subjected to time-scale modification;

an adjacent waveform readout position control section for reading out adjacent waveforms which emerge adjacent to each other on a time scale within the waveforms of the original audio signals and which are divided and cut by various lengths being sequentially changed;

a similarity calculation section for performing similarity evaluation on similarities which are calculated with respect to the adjacent waveforms;

a waveform readout control section for extracting a length that provides a best similarity between the adjacent waveforms as a basic period, so that two data whose times differ from each other by the basic period in connection with the adjacent waveforms are read from the waveform memory; and a time-scale modification processor, to perform at least one of deleting and inserting, at least a waveform of the basic period in the adjacent waveforms to produce output signals corresponding to results of the time-scale modification, which is performed on the original audio signals according to a designated time-scale modification factor without causing pitch variations, wherein the adjacent waveform readout position control section reads out the adjacent waveforms whose data are reduced by thinning out unwanted data on the time scale.

6. The time-scale modification apparatus according to claim 5, wherein the adjacent waveform readout position control section changes an interval of time used to thin out the unwanted data in response to the length by which the adjacent waveforms being compared with each other are divided and cut from the waveforms of the original audio signals.

7. The time-scale modification apparatus according to claim 5, wherein the adjacent waveform readout position control section determines an interval of time used for thinning out the unwanted data on the basis of the basic period, which is determined in a previous cycle of the similarity evaluation.

8. The time-scale modification apparatus according to claim 5, wherein the waveform of the basic period is deleted from the adjacent waveforms when the time-scale modification corresponds to compression with respect to time, and wherein the waveform of the basic period is inserted into the adjacent waveforms when the time-scale modification corresponds to expansion with respect to time.

9. The time-scale modification apparatus according to claim 5, wherein the adjacent waveform readout position control means determines an interval of time used for thinning out the unwanted data on the basis of the basic period, which is determined in a previous cycle of the similarity evaluation.

10. The time-scale modification apparatus according to claim 5, wherein the waveform of the basic period is deleted from the adjacent waveforms when the time-scale modification corresponds to compression with respect to time, and wherein the waveform of the basic period is inserted into the adjacent waveforms when the time-scale modification corresponds to expansion with respect to time.

11. A time-scale modification method comprising the steps of:

inputting an amount of original audio signals having waveforms;

reading out adjacent waveform segments, which are divided and cut from the original audio signals by various lengths and which emerge adjacent to each other on a time scale;

thinning out a certain number of samples from the adjacent waveform segments to provide a reduced amount of data regarding the adjacent waveform segments;

performing calculations on the reduced amount of data to sequentially produce similarities between the adjacent waveform segments in response to the various lengths being sequentially changed over;

evaluating the similarities to determine a length that provides a best similarity within the various lengths as a basic period;

dividing and cutting the waveforms of the original audio signals by the basic period to provide two first waveforms;

effecting time-scale modification on the two first waveforms to produce a mixed waveform corresponding to the basic period; and providing output signals incorporating the mixed waveform, which correspond to a result of the time-scale modification being effected on the original audio signals according to a designated time-scale modification factor.

12. The time-scale modification method according to claim 11, wherein the mixed waveform substitutes for the two first waveforms when the time-scale modification corresponds to compression with respect to time, and wherein the mixed waveform is inserted between the two first waveforms when the time-scale modification corresponds to expansion with respect to time.

13. The time-scale modification method according to claim 11, wherein a single sample is thinned out per every two samples within each of the waveform segments.

14. The time-scale modification method according to claim 11, wherein two samples are thinned out per every three samples within each of the waveform segments.

15. A machine-readable media to store programs and data that cause a computer system to perform a time-scale modification method comprising the steps of:

performing similarity evaluation to evaluate similarities between adjacent waveforms of original audio signals on a time scale to extract a basic period that provides a best similarity;

performing at least one of deleting and inserting, at least one waveform of the basic period in the adjacent waveforms of the original audio signals; and producing output signals corresponding to results of a time-scale modification which is effected on the original audio signals according to a designated time-scale modification factor without causing pitch variations, wherein the similarity evaluation is performed on a reduced amount of data which are provided by thinning out unwanted data from all data of the adjacent waveforms being compared with each other on the time scale.

16. The machine-readable media according to claim 15, wherein an interval of time for thinning out the unwanted data is varied in response to a length by which each of the adjacent waveforms is being divided.

17. The machine-readable media according to claim 15, wherein an interval of time for thinning out the unwanted data is determined based on the basic period, which is previously determined in a previous cycle of the similarity evaluation.

18. The machine-readable media according to claim 15, wherein the waveform of the basic period is deleted from the adjacent waveforms when the time-scale modification corresponds to compression with respect to time, and wherein the waveform of the basic period is inserted between the adjacent waveforms when the time-scale modification corresponds to expansion with respect to time.

19. A machine-readable media to store programs and data that cause a computer system to perform a time-scale modification method comprising the steps of:

inputting an amount of original audio signals having waveforms;

reading out adjacent waveform segments, which are divided and cut from the original audio signals by various lengths and which emerge adjacent to each other on a time scale;

thinning out a certain number of samples from the adjacent waveform segments to provide a reduced amount of data regarding the adjacent waveform segments;

performing calculations on the reduced amount of data to sequentially produce similarities between the adjacent waveform segments in response to the various lengths being sequentially changed over;

evaluating the similarities to determine a length that provides a best similarity within the various lengths as a basic period;

dividing and cutting the waveforms of the original audio signals by the basic period to provide two first waveforms;

effecting time-scale modification on the two first waveforms to produce a mixed waveform corresponding to the basic period; and providing output signals incorporating the mixed waveform, which correspond to a result of the time-scale modification being effected on the original audio signals according to a designated time-scale modification factor.

20. The machine-readable media according to claim 19, wherein the mixed waveform substitutes for the two first waveforms when the time-scale modification corresponds to compression with respect to time, and wherein the mixed waveform is inserted between the two first waveforms when the time-scale modification corresponds to expansion with respect to time.

21. A time-scale modification apparatus, comprising:

a waveform memory means for storing a certain amount of waveforms of original audio signals being subjected to time-scale modification;

an adjacent waveform readout position control means for reading out adjacent waveforms which emerge adjacent to each other on a time scale within the waveforms of the original audio signals and which are divided and cut by various lengths being sequentially changed;

a similarity calculation means for performing similarity evaluation on similarities which are calculated with respect to the adjacent waveforms;

a waveform readout control means for extracting a length that provides a best similarity between the adjacent waveforms as a basic period, so that two data whose times differ from each other by the basic period in connection with the adjacent waveforms are read from the waveform memory means; and a time-scale modification means, to perform at least one of deleting and inserting, at least a waveform of the basic period in the adjacent waveforms to produce output signals corresponding to results of the time-scale modification, which is performed on the original audio signals according to a designated time-scale modification factor without causing pitch variations, wherein the adjacent waveform readout position control means reads out the adjacent waveforms whose data are reduced by thinning out unwanted data on the time scale.

22. The time-scale modification apparatus according to claim 21, wherein the adjacent waveform readout position control means changes an interval of time used to thin out the unwanted data in response to the length by which the adjacent waveforms being compared with each other are divided and cut from the waveforms of the original audio signals.

* * * * *